US005445090A

United States Patent [19]

Conley, Jr.

[11] Patent Number: 5,445,090

[45] Date of Patent: Aug. 29, 1995

[54] INTERCHANGEABLE CLAMP FOR USE IN A SEWING MACHINE

[75] Inventor: Ralph F. Conley, Jr., Miamisburg, Ohio

[73] Assignee: MIM Industries, Inc.

[21] Appl. No.: 735,822

[22] Filed: Jul. 25, 1991

[51] Int. Cl.[6] ..... D05B 21/00

[52] U.S. Cl. ..... 112/102.5; 112/114; 112/470.06; 112/475.19

[58] Field of Search ..... 112/121.12, 121.15, 112/265.1, 262.3, 103, 102, 104, 114, 119; 269/55, 56, 58, 88, 111, 45; 38/102.2, 102.4

[56] References Cited

U.S. PATENT DOCUMENTS

| | | | |
|---|---|---|---|
| 164,241 | 6/1875 | Wheeler | 112/136 X |
| 271,688 | 2/1883 | Davis | 112/119 |
| 278,485 | 5/1883 | Arnold | 112/2 |
| 1,222,618 | 4/1917 | Gammons | 112/114 |
| 1,387,034 | 8/1921 | Barron et al. | 112/114 |
| 1,569,231 | 1/1926 | Mayo | 112/121.15 X |
| 2,223,626 | 12/1940 | Ladue | 112/2 |
| 2,630,087 | 3/1953 | Liero et al. | 112/114 |
| 2,726,613 | 12/1955 | Eddy | 112/114 |
| 3,104,637 | 9/1963 | Hedegaard | 112/104 |
| 3,664,283 | 5/1972 | McFalls | 112/121.15 |
| 3,664,288 | 5/1972 | Von Boden et al. | 112/103 |
| 3,799,086 | 3/1974 | Block | 112/121.15 |
| 3,830,175 | 8/1974 | Levor | 112/121.12 |
| 3,875,877 | 4/1975 | Fox | 112/63 |
| 3,875,878 | 4/1975 | Kaminski | 112/116 |
| 3,970,016 | 7/1976 | Yanikoski | 112/121.12 |
| 4,171,672 | 10/1979 | Dorosz et al. | 112/121.12 |
| 4,247,998 | 2/1981 | Foss | 38/102.2 |
| 4,273,059 | 6/1981 | Kamal | 112/121.14 |
| 4,296,699 | 10/1981 | Vartoukian | 112/121.15 |
| 4,305,338 | 12/1981 | Adamson | 112/113 |
| 4,455,952 | 6/1984 | Morin et al. | 112/121.12 |
| 4,462,320 | 7/1984 | Scholl | 112/104 |
| 4,479,447 | 10/1984 | Rohr | 112/141 |
| 4,493,276 | 1/1985 | Sadeh | 112/121.12 |
| 4,498,407 | 2/1985 | Landwehr et al. | 112/308 |
| 4,503,788 | 3/1985 | Giannuzzi et al. | 112/121.12 |
| 4,534,303 | 8/1985 | Off et al. | 112/114 |
| 4,603,647 | 8/1986 | Conley, Jr. et al. | 112/129 |
| 4,610,210 | 9/1986 | Kinoshita et al. | 112/121.12 |
| 4,622,907 | 11/1986 | Kimura | 112/121.12 |
| 4,639,964 | 2/1987 | Binder | 12/142 |
| 4,664,045 | 5/1987 | Landwehr et al. | 112/153 |
| 4,682,551 | 7/1987 | Toman | 112/103 |
| 4,696,242 | 9/1987 | Scholl et al. | 112/121.14 |
| 4,708,072 | 11/1987 | Frye | 112/121.27 |
| 4,719,863 | 1/1988 | Bisson | 112/121.15 |
| 4,763,587 | 8/1988 | Frye | 112/121.12 |
| 4,799,438 | 1/1989 | Hishckle | 112/121.12 |
| 4,854,251 | 8/1989 | Hiramatsu et al. | 112/121.12 |
| 4,870,917 | 10/1989 | Frye | 112/121.12 |
| 4,883,006 | 11/1989 | Marii et al. | 112/121.12 |
| 4,903,620 | 2/1990 | Bisson et al. | 112/121.15 X |
| 4,920,904 | 5/1990 | Frye | 112/262.1 |
| 4,989,525 | 2/1991 | Portilla | 112/10 |
| 5,005,501 | 4/1991 | Kita | 112/121.12 |
| 5,014,633 | 5/1991 | Murata et al. | 112/121.12 |

FOREIGN PATENT DOCUMENTS

| | | | |
|---|---|---|---|
| WO89/10443 | 11/1989 | WIPO | 112/114 |

OTHER PUBLICATIONS

"The Technologies of MIM Industries, Inc." Sales Brochure, published approximately Jan. 1, 1990.

*Primary Examiner*—Peter Nerbun
*Attorney, Agent, or Firm*—Biebel & French

[57] ABSTRACT

An interchangeable clamp having a plurality of interchangeable members which can be secured together to provide a clamp frame having a predetermined configuration. The predetermined configuration and clamp area of the clamp frame can be changed by substituting the interchangeable members with other interchangeable members having different shapes or sizes. The interchangeable members may be selected from a set of interchangeable members which make it easy for a user to change the configuration of the interchangeable clamp.

22 Claims, 3 Drawing Sheets

30
52
52-2
62
74
67
72
68
68-1
70
56
56-1
58
58-1
58-2
60
60-1
64
C

INTERCHANGEABLE CLAMP FOR USE IN A SEWING MACHINE

BACKGROUND OF THE INVENTION

1. Field of the Invention

This invention relates to a clamp, and more particularly, it relates to an interchangeable clamp having a plurality of interchangeable members which may be secured together to provide a clamp frame having a predetermined configuration.

2. Description of Related Art

In the sewing industry, a common repetitive function is to sew a label onto a workpiece of material. For example, this would be a common procedure when sewing a manufacturer's label onto a workpiece, such as a shirt or jacket. A clamp is typically used to force the label against the workpiece and also against a sewing surface of a sewing machine. The sewing machine then moves the workpiece and label under an oscillating needle in order to sew the label onto the workpiece with a predetermined stitch pattern. The clamp was also used to secure either the label or the workpiece against the sewing surface so that the predetermined stitch pattern could be sewn thereon. The clamps of the prior art had a defined clamping configuration which could not be adjusted to accommodate labels of different shapes or to accommodate different predetermined stitch patterns. Accordingly, a user was required to maintain an inventory of clamps for each workpiece shape and for each predetermined stitch pattern. Maintaining such an inventory of clamps was expensive.

Still another problem is that the programmable sewing machine had to be shut down whenever the interchangeable clamp had to be changed due to a change in either the predetermined stitch pattern or the workpiece shape. This downtime resulted in lost production and labor time.

SUMMARY OF THE INVENTION

There is, therefore, a present need to provide an interchangeable clamp having a plurality of interchangeable members which can be configured to provide an interchangeable clamp having a preselected configuration.

In one aspect of the invention, this invention includes an interchangeable clamp comprising: a plurality of interchangeable members; securing means for adjustably securing said plurality of interchangeable members together to provide a clamp frame having a preselected configuration; and a connector coupled to said clamp frame to permit the interchangeable clamp to be detachably connected to a programmable sewing machine.

An object of this invention is to provide an interchangeable clamp having interchangeable members which enables the clamp to clamp labels or workpieces having different shapes against a sewing surface in a programmable sewing machine.

Another object of this invention is to provide an interchangeable clamp which can be configured in order to accommodate a change in a predetermined stitch pattern being sewn on a label or workpiece.

Another object of this invention is to provide an interchangeable clamp which eliminates the need for maintaining an inventory of clamps of different shapes and sizes.

Still another object of this invention is to provide an interchangeable clamp which can be easily configured to provide an clamp having a predetermined configuration.

Yet another object of this invention is to provide a method which permits an operator to quickly and easily interchange interchangeable members to change the configuration of the clamp.

These objects, and others, may be more readily understood in connection with the following specification, claims, and drawing.

DESCRIPTION OF THE PREFERRED EMBODIMENT

Figure 1:
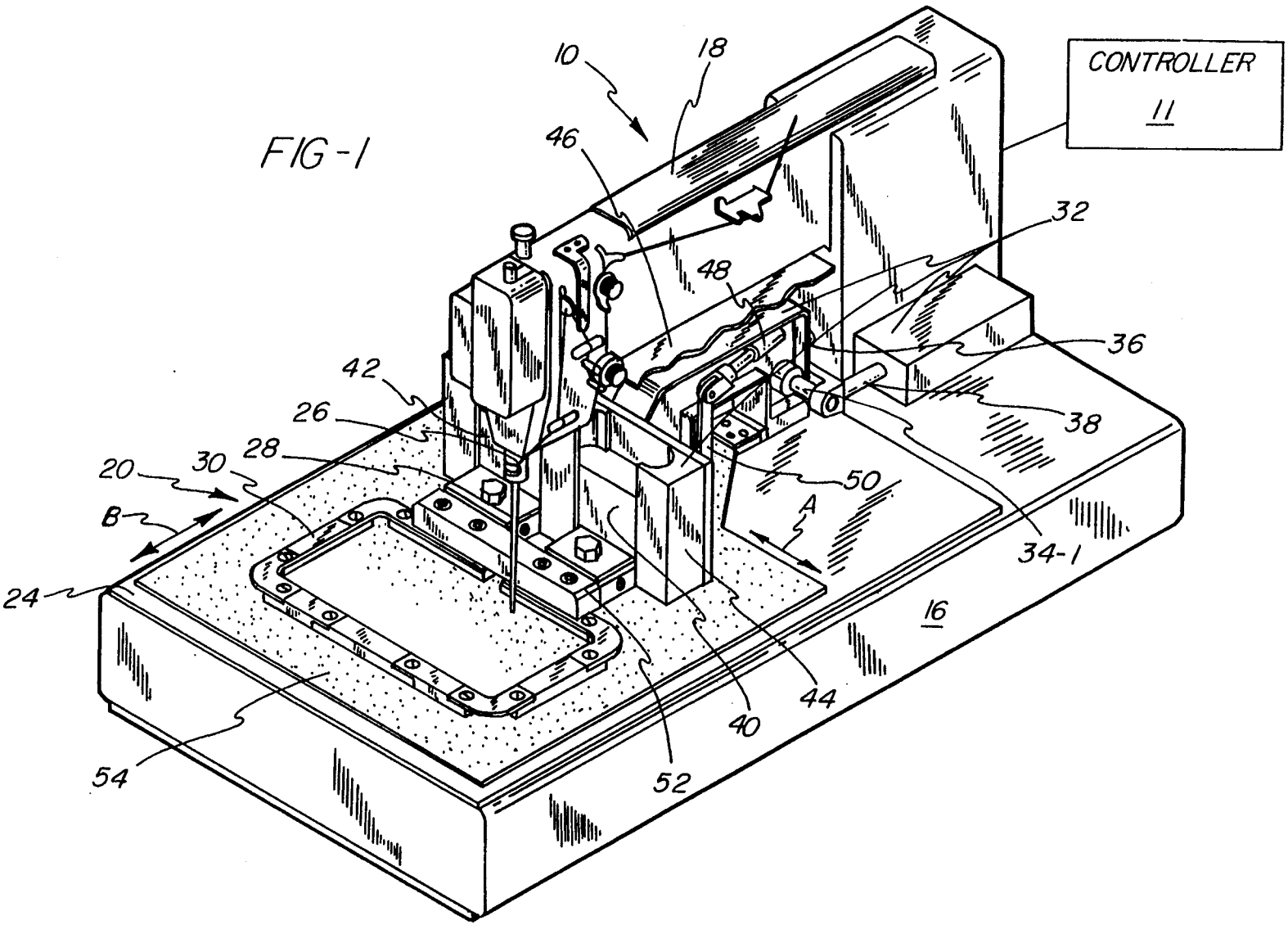
FIG. 1 is a perspective view of a programmable sewing machine in which a preferred embodiment of this invention may be used.

FIG. 1 shows a perspective view of a programmable sewing machine, hereinafter designated as sewing machine 10, in which a preferred embodiment of this invention may be used. The function of the sewing machine 10 is to sew a workpiece 12 (FIG. 2), such as a label or shirt pocket, onto a second workpiece 13, like a jacket or shirt. In a preferred embodiment, the workpiece 12 is sewn onto the second workpiece 13 with a predetermined stitch pattern (not shown) in accordance with a computer program (not shown) which is controlled by a controller 11 in the sewing machine 10. The sewing machine 10 may be any programmable sewing machine, including any of the Brother BAS Series 300 programmable sewing machines, such as the BAS Model M340, which are manufactured by Brother Industries of Japan. The sewing machine 10 comprises a base 16 having a horizontal arm 18 secured thereto. The sewing machine 10 also comprises a sewing station 20 at which the workpiece 12 can be sewn onto the second workpiece 13 with the predetermined stitch pattern. The sewing station 20 includes a sewing surface 24. The horizontal arm 18 extends out over the sewing surface 24, and it has a needle holder 26 near the end thereof. The needle holder 26 supports a needle 28 for reciprocating motion in a fixed path that is generally vertical and perpendicular to the sewing surface 24. The needle 28 moves down through a hole (not shown) in a throat plate (not shown) at the bottom of its stroke to transfer a loop of thread (not shown) to a loop taker (not shown) under the sewing surface 24 at the sewing station 20. The loop taker and needle 28 are both connected to a motor (not shown) which is controlled by the master controller 11 in the sewing machine 10.

The sewing machine 10 further includes an interchangeable clamp 30 which is coupled to drive means 32. The function of the drive means 32 is to move the interchangeable clamp 30 at the sewing station 20 in accordance with the computer program (not shown) so that the workpiece 12 can be sewn on the second workpiece 13.

The drive means 32 comprises a yoke shaft 34-1 of a yoke which permits the interchangeable clamp 30 to move in an X direction, indicated by double arrow A in FIG. 1. The yoke 34 is coupled to a pair of shafts 36 and 38 which can cause the yoke 34 and interchangeable clamp 30 to move in a Y direction, indicated by double arrow B in FIG. 1. The shafts 36 and 38 are coupled to a stepper motor (not shown) by various belts, gears, and pulleys (not shown) in the sewing machine 10. As best illustrated in FIG. 1, the interchangeable clamp 30 is coupled to a pair of L-shaped brackets 40 and 42 which are slidably mounted in a support housing 44 of a support arm 46.

The drive means 32 also comprises a solenoid 48 which is coupled to L-shaped bracket 40 by armature 50. The drive means 32 may also include a solenoid (not shown) and armature (not shown) for driving the L-shaped bracket 42. The support arm 42 is coupled to a second stepper motor (not shown) under sewing surface 24. Although not shown, the drive means 32 could include a different configuration of drive mechanisms, solenoids, motors, gears, and pulleys, or it could include any other suitable means for moving the interchangeable clamp 30 in the X or Y directions or towards and away from the sewing surface 24.

The controller 11 can energize the stepper motor and the second stepper motor individually, or simultaneously, to move the interchangeable clamp 30 in the X or Y directions, thereby permitting the sewing machine 10 to move the interchangeable clamp 30 in accordance with the computer program so that the workpiece 12 can be sewn on the second workpiece 13 with the predetermined stitch pattern. In addition, the master controller can also energize the solenoid 48 to cause the L-shaped brackets 40 and 42 and the interchangeable clamp 30 to move towards and away from the sewing surface 24.

The sewing machine 10 also comprises mounting means, including a connector 52 (FIG. 1) for detachably mounting the interchangeable clamp 30 to the L-shaped brackets 40 and 42. The connector 52 comprises a quick-release mechanism which enables the interchangeable clamp 30 to be quickly and easily mounted and dismounted from the sewing machine 10. The quick release mechanism is similar to the release mechanisms shown and described in U.S. Pat. No. 4,763,587, issued on Aug. 16, 1988, and U.S. Pat. No. 4,870,917, issued on Oct. 3, 1989, which are assigned to the same assignee as the present application and which are hereby incorporated by reference and made a part hereof. Although not shown, the connector 52 could include different means for mounting the interchangeable clamp 30 to the sewing machine 10, such as machine screws, bolts, welding, or any other suitable means for securing the interchangeable clamp 30 to the sewing machine 10.

Figure 2:
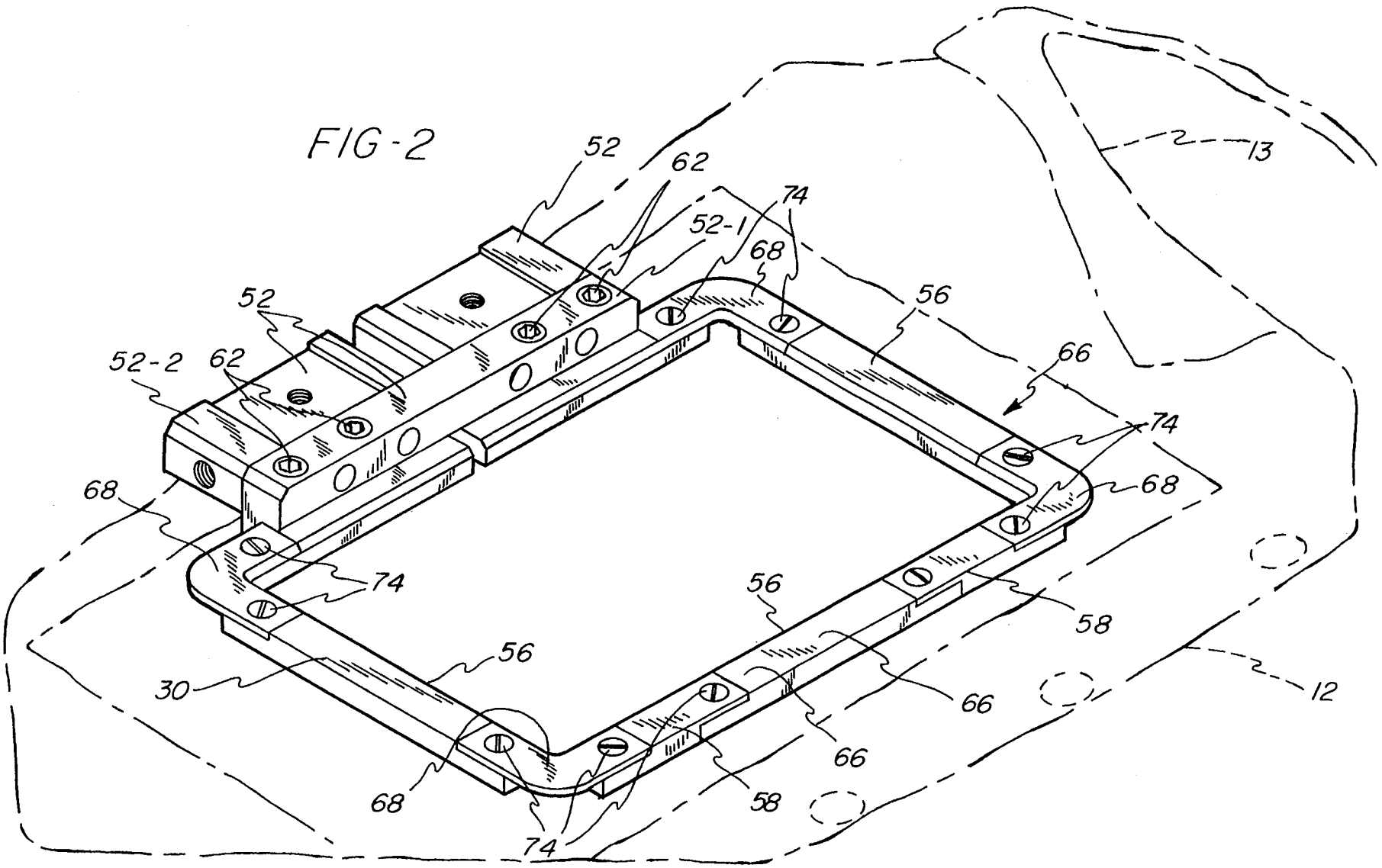
FIG. 2 is an assembled perspective view of an interchangeable clamp according to one embodiment of this invention.
Figure 3:
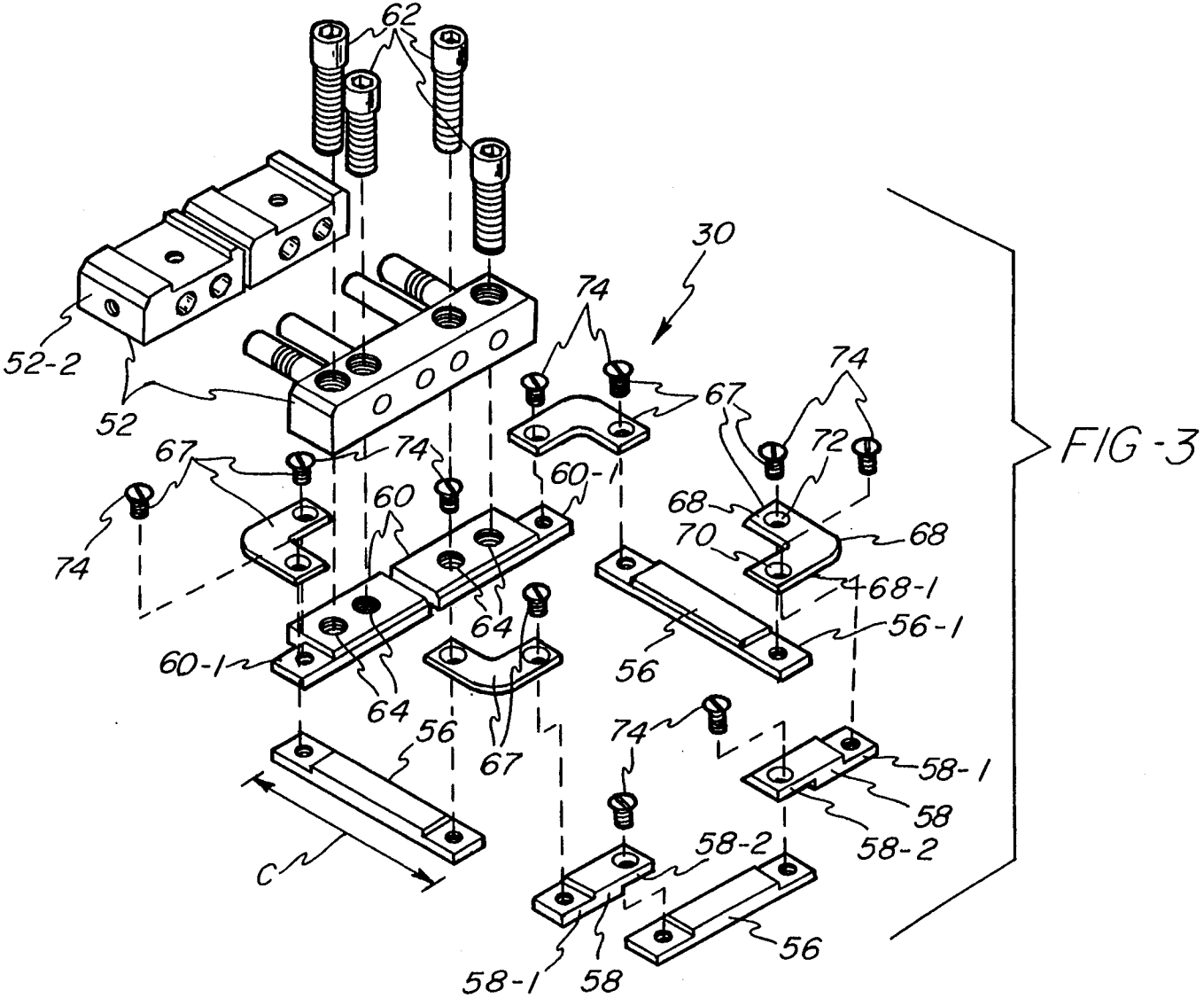
FIG. 3 is a perspective exploded view of the interchangeable clamp shown in FIG. 2.

As best shown in FIGS. 2 and 3, the sewing machine 10 comprises the interchangeable clamp 30 which forces the workpiece 12 (FIG. 2) against the second workpiece 13 until the workpiece 12 and second workpiece 13 are secured firmly against a cloth plate 54 (FIG. 1). The interchangeable clamp 30 comprises a plurality of interchangeable members 56, 58 and 60 which are generally planar and elongated as best shown in FIG. 3. In the embodiment being described, the interchangeable members have a step thereon for facilitating connecting the interchangeable members 52 together. The interchangeable members 60 have a plurality of threaded holes 58. A plurality of machine screws 62 secure the male member 52-1 of the connector 52 to the threaded holes 64, as shown. The interchangeable members 58 are generally Z-shaped and are stepped on end 58-1. The interchangeable members 60 are stepped at an end 56-1.

The interchangeable clamp 30 also comprises securing means 67 for adjustably securing the plurality of interchangeable members 56, 58, and 60 together to provide a clamp frame 66 (FIG. 2) having a preselected configuration. In the embodiment being described, the securing means 67 comprises a plurality of generally L-shaped connector members 68. Each of the plurality of generally L-shaped connector members 68 has a first end 68-1 and a second end 68-2. As best illustrated in FIG. 3, each of the generally L-shaped connector members 68 also has apertures 70 and 72 located on said first and second ends 68-1 and 68-2, respectively. The generally L-shaped connector members 68 are positioned between adjacent interchangeable members 56, 58 and 60, as shown. Each of the steps in the interchangeable members 56, 58, and 60, has a threaded hole therein which becomes aligned with, for example, either aperture 70 or 72 as shown. After the generally L-shaped connector members 62 have been positioned between adjacent interchangeable members 56, 58 and 60, as shown in FIG. 3, they are screwed or fastened together with the screws 74 which are also part of the securing means 67. As best illustrated in FIG. 2, the generally L-shaped connector members 68 and the screws 74 cooperate to permit the L-shaped connector members 68 and the plurality of interchangeable members 56, 58, and 60 to be secured together to provide a one-piece clamp frame 66 having a preselected configuration. These screws 74 may then be loosened or removed so that the L-shaped connector member 68 and plurality of interchangeable members 56, 58 and 60 can be adjusted to a second preselected configuration. Alternatively, the plurality of interchangeable members 56, 58 and 60 may be substituted with substitute interchangeable members (not shown), as described below. Thus, in the embodiment being described, the preselected configuration may be adjusted to the shape or size desired by the user. It is to be noted that, for example, the apertures 70 and 72 of the right-most interchangeable member 68 (as viewed in FIG. 3) become generally aligned with the threaded holes on the steps in the interchangeable members 56 and 58 on ends 56-1 and 58-1, respectively, when the generally L-shaped connector member 62 becomes seated in the steps as shown in FIG. 2. Thus, the steps enable the generally L-shaped connector members 68 to be quickly aligned on the plurality of interchangeable members 56, 58, and 60. Although not shown, the generally L-shaped brackets may have a different shape, depending on the shape of the configuration selected.

The securing means 67 enables the interchangeable clamp 30 to be configured to any preselected configuration by substituting the interchangeable members 56, 58, and 60, with substitute interchangeable members (not shown). For example, the interchangeable members 56 could be replaced with other interchangeable member 56 (not shown) having a length, longer or shorter than the length C, shown in FIG. 3, thereby permitting the configuration of the clamp frame 66 to be made larger or smaller, respectively. The ability to substitute interchangeable members 56 enables the configuration of the interchangeable clamp 30 to be changed to many different preselected configuration sizes or shapes. The interchangeable members 56, 58, and 60 may be provided in a set (not shown) having a plurality of interchangeable members 56, 58, and 60 of different shapes and sizes. This permits a user to select the appropriate size interchangeable members 56, 58, and 60 from the set so that the interchangeable clamp 30 may be adjusted to the user's desired configuration.

Although not shown, the interchangeable members 56, 58, and 60 could have shapes other than the elongated planar shape shown in FIG. 3, for example, which would permit the interchangeable clamp 30 to be configured in any desired shape. For example, the interchangeable members 56, 58, and 60 could be curved or circular so that they provide a clamp frame 66 having a circular clamp configuration when they are assembled together.

In operation, the clamp configuration is selected and the plurality of interchangeable members 56, 58 and 60 for making that configuration are selected from a set of interchangeable members 56, 58 and 60. After the interchangeable members 56, 58 and 60 are selected, the L-shaped connector members 68 are guided over the steps of the interchangeable members 56, 58 and 60 as shown in FIG. 3. The screws 74 are used to secure the L-shaped connector members 68 to the interchangeable members 56, 58, and 60. The machine screws 62 are used to couple the male member 52-1 of the connector 52 to the interchangeable members 56, 58, and 60 as shown. The male member 52-1 can then be detachably mounted to the female member 52-2, thereby securing the interchangeable clamp to the sewing machine 10. Although not shown, the configuration of the interchangeable clamp 30 could be adjusted while the interchangeable clamp 30 is mounted to the sewing machine 10. This can be done by unscrewing the screws 74, changing or rearranging the interchangeable members 56, 58, and 60, and then retightening the screws 74, thereby providing a new configuration and predetermined clamp size, pattern or configuration.

After the interchangeable clamp 30 has been configured to the appropriate predetermined clamp size and preselected configuration, it is mounted to the sewing machine 10. The second workpiece 13 can be positioned on the cloth plate 54, and the workpiece 12 can then be positioned on the second workpiece 13. The controller 11 can then energize drive means 32 to cause the interchangeable clamp 30 to clamp the workpiece 12 against the second workpiece 13 so that the workpiece 12 can be sewn onto the second workpiece 13 with the predetermined stitch pattern. In addition, the interchangeable clamp 30 could be used to secure either the workpiece 12 or the second workpiece 13 against the cloth plate 54 so that a sewing machine 10 can sew the predetermined stitch pattern thereon. This may be beneficial when sewing, for example, an ornamental pattern (not shown) on a label (not shown).

Various changes or modifications in the invention described may occur to those skilled in the art without departing from the spirit or scope of the invention. For example, in the embodiment shown and described herein, the configuration of the clamp frame 66 is rectangular; however, it could be any suitable shape depending on either the size of the workpiece to be clamped or the predetermined stitch pattern to be sewn. The above description of the invention is intended to be illustrative and not limiting, and it is not intended that the invention be restricted thereto, but that it be limited only by the true spirit and scope of the appended claims.

What is claimed is:

1. An interchangeable clamp comprising:

a plurality of interchangeable members;

securing means for adjustably securing said plurality of interchangeable members together to provide a clamp frame having a preselected configuration; and a connector coupled to said clamp frame to permit the interchangeable clamp to be detachably connected to a programmable sewing machine such that said clamp frame can force a workpiece against a clamping surface in said programmable sewing machine.

2. The interchangeable clamp as recited in claim 1 wherein said plurality of interchangeable members are selected from a set of interchangeable members.

3. The interchangeable clamp as recited in claim 1 wherein said connector comprises a quick-release mechanism.

4. The interchangeable clamp as recited in claim 1 wherein said preselected configuration is generally rectangular in shape.

5. The interchangeable clamp as recited in claim 1 wherein said plurality of interchangeable members are generally planar.

6. The interchangeable clamp as recited in claim 1 wherein each of said plurality of interchangeable members are elongated and have at least one step thereon.

7. The interchangeable clamp as recited in claim 1 wherein said securing means comprises a plurality of generally L-shaped connector members.

8. The interchangeable clamp as recited in claim 6 wherein at least one of said plurality of interchangeable members has a flange at said first end to permit the interchangeable member to mate with the step of an adjacent interchangeable member so that said interchangeable member can be coupled to said adjacent interchangeable member.

9. An interchangeable clamp comprising:

a plurality of interchangeable members;

securing means for adjustably securing said plurality of interchangeable members together to provide a clamp frame having a preselected configuration; and a connector coupled to said clamp frame to permit the interchangeable clamp to be detachably connected to a programmable sewing machine;

said securing means comprising a plurality of generally L-shaped connector members;

said securing means further comprising a plurality of screws;

each of said plurality of interchangeable members having at least one seat located thereon, said at least one seat having a threaded hole therethrough;

each of said plurality of generally L-shaped connector members having a first end and a second end, said first and second ends each having an aperture therethrough;

said aperture of said first or second end becoming generally aligned with said threaded hole in said step when said first end or said second end, respectively, engages said step;

said generally L-shaped connector members causing adjacent interchangeable members to be aligned so that said screws can be used to secure said adjacent interchangeable members together.

10. A programmable sewing machine for sewing a predetermined stitch pattern on a workpiece, said sewing machine comprising:

a controller for controlling the operation of the programmable sewing machine;

an interchangeable clamp for forcing a workpiece having a predetermined shape against a clamping surface in the programmable sewing machine, said interchangeable clamp being adjustable in order to accommodate workpieces of different shapes;

drive means coupled to said controller and said interchangeable clamp for driving the clamp into engagement with the workpiece to secure the workpiece against the clamping surface, said drive means also being capable of moving said workpiece in accordance with a program stored in the programmable sewing machine in order to sew the predetermined stitch pattern on the workpiece;

said interchangeable clamp being adjustable to permit the programmable sewing machine to clamp workpieces of different shapes against the clamping surface so that the predetermined stitch pattern can be sewn on the workpiece when said controller causes said drive means to move the workpiece in accordance with said program;

said interchangeable clamp comprising:

a plurality of interchangeable members;

securing means for adjustably securing said plurality of interchangeable members together to provide a clamp frame having a preselected configuration, said securing means permitting said plurality of interchangeable members to be interchanged to provide a clamp frame having a second preselected configuration; and a connector coupled to said clamp frame to permit the interchangeable clamp to be detachably connected to a programmable sewing machine.

11. The programmable sewing machine as recited in claim 10 wherein said plurality of interchangeable members are selected from a set of interchangeable members.

12. The programmable sewing machine as recited in claim 10 wherein said connector comprises a quick-release mechanism.

13. The programmable sewing machine as recited in claim 10 wherein said preselected configuration is generally rectangular in shape.

14. The programmable sewing machine as recited in claim 10 wherein said plurality of interchangeable members are generally planar.

15. The programmable sewing machine as recited in claim 10 wherein each of said plurality of interchangeable members are elongated and have at least one step thereon.

16. The programmable sewing machine as recited in claim 15 wherein at least one of said plurality of interchangeable members has a flange at said first end to permit the interchangeable member to mate with the step of an adjacent interchangeable member so that said interchangeable member can be coupled to said adjacent interchangeable member.

17. The programmable sewing machine as recited in claim 10 wherein said securing means comprises a plurality of generally L-shaped connector members which cooperate to secure said plurality of interchangeable members together in said preselected configuration.

18. A programmable sewing machine for sewing a predetermined stitch pattern on a workpiece, said sewing machine comprising:

a controller for controlling the operation of the programmable sewing machine;

an interchangeable clamp for forcing a workpiece having a predetermined shape against a clamping surface in the programmable sewing machine, said interchangeable clamp being adjustable in order to accommodate workpieces of different shapes; and drive means coupled to said controller and said interchangeable clamp for driving the clamp into engagement with the workpiece to secure the workpiece against the clamping surface, said drive means also being capable of moving said clamping surface in accordance with a program stored in the programmable sewing machine in order to sew the predetermined stitch pattern on the workpiece;

said interchangeable clamp being adjustable to permit the programmable sewing machine to clamp workpieces of different shapes against the clamping surface so that the predetermined stitch pattern can be sewn on the workpiece when said controller causes said drive means to move the clamping surface in accordance with said program;

said interchangeable clamp further comprising:

a plurality of interchangeable members;

securing means for adjustably securing said plurality of interchanqeable members together to provide a clamp frame having a preselected configuration, said securing means permitting said interchangeable members to be interchanged to provide a clamp frame having a second preselected configuration; and a connector coupled to said clamp frame to permit the interchangeable clamp to be detachably connected to a programmable sewing machine;

said securing means further comprising a plurality of generally L-shaped connector members which cooperate to secure said plurality of interchangeable members together in said preselected configuration;

said securing means comprises a plurality of screws;

each of said plurality of interchangeable members having at least one seat located thereon, said at least one seat having a threaded hole therethrough;

each of said plurality of generally L-shaped connector members having a first end and a second end, said first and second ends each having an aperture therethrough;

said aperture of said first or second end becoming generally aligned with said threaded hole in said at least one seat when said first end or said second end, respectively, engages said at least one seat;

said generally L-shaped connector members causing adjacent interchangeable members to be aligned so that said screws can be used to secure said adjacent interchangeable members together.

19. A programmable sewing machine for sewing a predetermined stitch pattern on a workpiece, said sewing machine comprising:

a controller for controlling the operation of the programmable sewing machine;

an interchangeable clamp for forcing a workpiece having a predetermined shape against a clamping surface in the programmable sewing machine, said interchangeable clamp being adjustable in order to accommodate workpieces of different shapes;

drive means coupled to said controller and said interchangeable clamp for driving the clamp into engagement with the workpiece to secure the workpiece against the clamping surface, said drive means also being capable of moving said clamping surface in accordance with a program stored in the programmable sewing machine in order to sew the predetermined stitch pattern on the workpiece;

said interchangeable clamp being adjustable to permit the programmable sewing machine to clamp workpieces of different shapes against the clamping surface so that the predetermined stitch pattern can be sewn on the workpiece when said controller causes said drive means to move the clamping surface in accordance with said program;

said interchangeable clamp comprising:

a plurality of interchangeable members selected from a set of interchangeable members, said plurality of interchangeable members being elongated and generally planar;

securing means for adjustably securing said plurality of interchangeable members together to provide a clamp frame having a generally rectangular configuration, said securing means comprising a plurality of generally L-shaped connector members adapted for connecting one of said plurality of interchangeable members to another of said plurality of interchangeable members; and a connector having a quick-release mechanism coupled to said clamp frame, said quick-release mechanism being capable of connecting the interchangeable clamp to the programmable sewing machine.

20. The programmable sewing machine as recited in claim 19 wherein said securing means comprises a plurality of screws;

each of said plurality of interchangeable members having at least one seat located thereon, said at least one seat having a threaded hole therethrough;

each of said plurality of generally L-shaped connector members having a first end and a second end, said first and second ends each having an aperture therethrough;

said aperture of said first or second end becoming generally aligned with said threaded hole in said step when said first end or said second end, respectively, engages said step;

said generally L-shaped connector members causing adjacent interchangeable members to be aligned so that said screws can be used to secure said adjacent interchangeable members together.

21. A method for clamping a workpiece against a sewing surface of a sewing machine, said method comprising the steps of:

(a) providing an interchangeable clamp having a plurality of interchangeable members which can be adjustably secured together to provide a clamp frame having a preselected clamp configuration;

(b) selecting said preselected clamp configuration;

(c) adjustably securing said plurality of interchangeable members together to provide said preselected clamp configuration; and (d) causing said interchangeable clamp to force the workpiece against the sewing surface, thereby clamping the workpiece in the sewing machine.

22. The method as recited in claim 21 wherein said step (a) further includes the step of:

(a)(1) selecting said plurality of interchangeable members from a set of interchangeable members.

* * * * *